US005362542A

United States Patent [19]

Ozawa et al.

[11] Patent Number: 5,362,542

[45] Date of Patent: Nov. 8, 1994

[54] FIBER REINFORCED PLASTIC REINFORCEMENT FOR CONCRETE

[75] Inventors: Nobuyuki Ozawa, Tokyo; Junji Hosokawa, Kanagawa; Masao Kikuchi, Tokyo; Tokitaro Hoshijima, Tokyo; Kensuke Yagi, Tokyo, all of Japan

[73] Assignees: Komatsu Plastics Industry Co., Ltd.; Mitsubishi Kasei Corporation, Japan

[21] Appl. No.: 28,120

[22] Filed: Mar. 9, 1993

[30] Foreign Application Priority Data

Mar. 13, 1992 [JP] Japan ..... 4-088309
Feb. 23, 1993 [JP] Japan ..... 5-033208

[51] Int. Cl.[5] ..... B32B 1/04

[52] U.S. Cl. ..... 428/70; 428/156; 428/163; 428/167; 428/171; 428/703; 428/902

[58] Field of Search ..... 428/70, 156, 163, 167, 428/171, 703, 902, 364, 377

[56] References Cited

U.S. PATENT DOCUMENTS 4,620,401 11/1986 L'Espérance ..... 428/294
4,958,961 9/1990 Herbst et al. .
5,234,765 8/1993 Taylor et al. ..... 428/365

FOREIGN PATENT DOCUMENTS 0199348 10/1986 European Pat. Off. .
1936078 1/1971 Germany .
62-140115 9/1987 Japan .
63-206548 8/1988 Japan .
292624 4/1990 Japan .
333045 2/1991 Japan .
3129040 6/1991 Japan .
592890 10/1947 United Kingdom .

*Primary Examiner*—James J. Bell
*Attorney, Agent, or Firm*—Ronald P. Kananen

[57] ABSTRACT

A fiber reinforced plastic reinforcement for concrete structure comprises a core made of a fiber reinforced plastic material composed of a matrix resin and reinforcing fiber, uneven profile portion integrally formed on the peripheral surface portion of the core having alternately arranged first higher portions and second lower portions, and the reinforcing fiber extending in series across the core and the uneven profile portion.

14 Claims, 10 Drawing Sheets

FIBER REINFORCED PLASTIC REINFORCEMENT FOR CONCRETE

BACKGROUND OF THE INVENTION

1. Field of the Invention

The present invention relates generally to a reinforcement for a concrete structure. More specifically, the invention relates to a fiber reinforced plastic (FRP) reinforcement for a concrete structure.

2. Description of the Related Art

Steel have been commonly employed as reinforcements for concrete and pre-casted concrete. However, in the recent years, sea sand comes to be mixed with a concrete as aggregate to cause severe problem of corrosion of the steel as the reinforcement due to salt component and so forth adhering thereon. Once corrosion of the steel is caused, a bonding force between the steel and the concrete can be lowered or a crack or so forth can be caused in the concrete construction due to expansion of volume of the steel due to corrosion to result in degradation of durability of the concrete construction.

As a solution to this problem, corrosion resistive FRP rods becomes to be employed as the reinforcement for the concrete.

As in the steel reinforcements, the FRP reinforcement for the concrete is provided with the outer peripheral surface having uneven profile for strengthening bonding with the concrete. As shown in FIGS. 9 and 10, the conventional FRP reinforcement is formed with the uneven profile by a cutting process on the outer peripheral surface. Also, FIG. 11 shows the FRP reinforcement disclosed in Japanese Unexamined Utility Model Publication No. 62-140115, which is formed by winding a FRP strip d on a core of a FRP rod c and bonding thereon for forming projected portions.

Among these conventional FRP reinforcement for the concrete, the former, illustrated in FIGS. 9 and 10, encounters a problem of lowering of a tensile strength of the FRP per se since the reinforcing fiber forming a rod a can be cut during processing of grooves b. Furthermore, in this prior art, since the reinforcing fiber is cut, the core portion and the projected portions are bonded only by a matrix resin. Therefore, when such FRP rod is used as reinforcement for the concrete, it cannot be expected to increase resistance against shearing stress to be exerted between the core and the projected portion due to various load applied to the concrete structure.

On the other hand, the latter, illustrated in FIG. 11, may avoid lowering of the tensile strength of the FRPs per se which form the rod of the core c and the strip d forming the projected portions. However, even in this case, since the core c and the projected portion d are bonded by resin, it still encounters a problem in a resistance against the shearing stress.

Similar defect may raise a problem even when such reinforcement is employed in the pre-casted concrete. In case of the pre-casted concrete, by releasing of tension after curing of the concrete, a residual stress will be remained on the reinforcement so that a large shearing force is exerted between the core and the projected portion to potentially cause peeling off.

SUMMARY OF THE INVENTION

Therefore, it is an object of the present invention to provide a FRP reinforcement for a concrete structure which can improve strength of projected portions relative to a core in shearing direction with maintaining advantages of the FRP in property.

In order to accomplish the above-mentioned object, a FRP reinforcement for a concrete structure, according to the present invention, has an integral structure of a core portion and projected portions so that reinforcing fiber extends in series over the core portion and the projected portion.

The series fiber extending over the core portion and the projected portion may contribute for improving shearing strength of the projected portion relative to the core portion in the axial direction, and as well, for improving strength against a concentrated stress at the raising edge of the projected portion.

According to one aspect of the invention, a fiber reinforced plastic reinforcement for concrete structure comprises:

- a core made of a fiber reinforced plastic material composed of a matrix resin and reinforcing fiber;
- uneven profile portion integrally formed on the peripheral surface portion of the core having alternately arranged first higher portions and second lower portions; and
- the reinforcing fiber extending in series across the core and the uneven profile portion.

In the preferred construction, the first higher portions are positioned radially outside beyond the second lower portions in a distance range of 1/1000 to 1/10 times of a diameter of the reinforcement. Also, the width of the second lower portion is preferably in a range of 1/3 to 1/1 times of the diameter of the reinforcement. Furthermore, a pitch of the second lower portions is preferably in a range of 1 to 6 times of the diameter of the reinforcement.

In the practical construction, the first higher portions may be formed by projections formed integrally with the core, through which projections and the core, the reinforcing fiber extends in series. In this case, the first higher portions may be formed with a sequence of projection extending around the outer periphery of the core in spiral fashion. Alternatively, the first higher portions are formed with two elongated projections extending around the outer periphery of the core in mutually intersecting fashion.

In the alternative construction, the second lower portions are formed by grooves formed integrally with the core, through which grooves and the core, the reinforcing fiber extends in series. In such case, the second lower portions may be formed with a sequence of groove extending around the outer periphery of the core in spiral fashion. The second lower portions may alternative be formed with two elongated grooves extending around the outer periphery of the core in mutually intersecting fashion. In this case, the two grooves are formed on the outer periphery of the core in spiral fashion with mutually opposite spiral directions. Preferably, the groove is formed by impression in the fabrication process before completely curing of the matrix resin.

BRIEF DESCRIPTION OF THE DRAWINGS

The present invention will be understood more fully from the detailed description given herebelow and from the accompanying drawings of the preferred embodiments of the invention, which, however, should not be taken to be limitative to the invention, but are for explanation and understanding only.

In the drawings:

FIGS. 6A and 68 are diagrammatic illustration showing the manner of a four point static load test, in which FIG. 6A is a sectional front elevation.

FIGS. 7A and 78 are diagrammatic illustration showing the manner of load test in a precasted concrete structure, in which FIG. 7A is a sectional front elevation and FIG. 78 is a sectional side elevation;

FIGS. 8A and 88 are perspective view and front elevation of a stirrup and hoop reinforcements employing the reinforcement of the present invention;

DESCRIPTION OF THE PREFERRED EMBODIMENT

Figure 1:
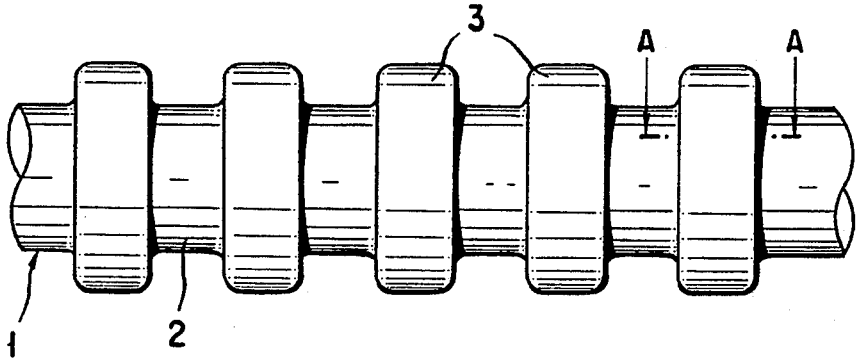
FIG. 1 is a front elevation of the preferred embodiment of a FRP reinforcement according to the present invention.
Figure 2A:
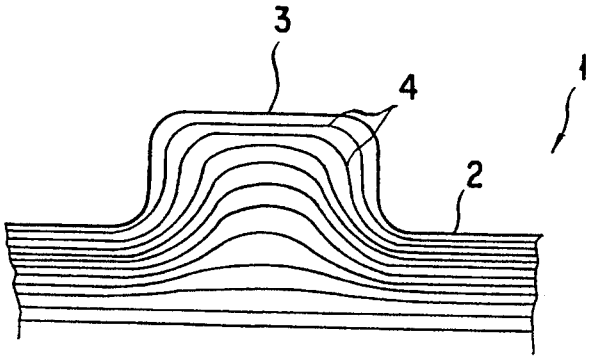
FIG. 2A is an enlarged section taken along line A—A of FIG. 1.

The preferred embodiment of a FRP reinforcement, according to the present invention will be discussed with reference to FIGS. 1 and 2.

In the drawings, the reference numeral 1 denotes the preferred embodiment of a FRP reinforcement for a concrete (which will be hereinafter referred to as "reinforcement") according to the present invention. The reinforcement 1 has the construction similarly to those in the prior art, in which projected portions 3 are projected from the outer circumference of a core portion 2 for providing an uneven surface profile. The projected portions 3 are formed integrally with the core portion 2. As shown in FIG. 2, reinforcing fiber 4 extends in series over the core portion 2 and the projected portions 3 without interruption at the projected portion 3.

Figure 3A:
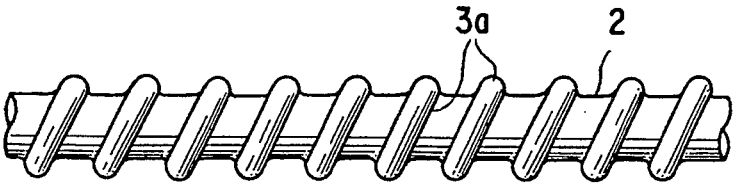
FIGS. 3A, 3B 3C and 3D are front elevations showing modifications of the preferred embodiment of the FRP reinforcement according to the invention.

Although the shown embodiment employs the projected portions in annular ring shaped configurations, the configuration of the projected portions should not be limited to the specific configuration as illustrated and can be various configurations, such as a spiral form, deformed form or so forth. For instance, the projected portion 3 can be of spiral configuration 3B as illustrated in FIG. 3A. In the alternative, grooves 5, **5*a* and 5*b* in spiral formed as illustrated in FIGS. 3B and 3C on the outer surface of the core portion 2**.

Figure 2B:
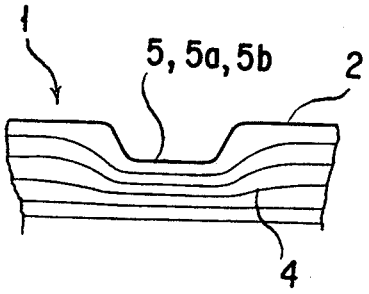
FIG. 2B is an enlarged section taken along line B—B of FIG. 3C.
Figure 3B:
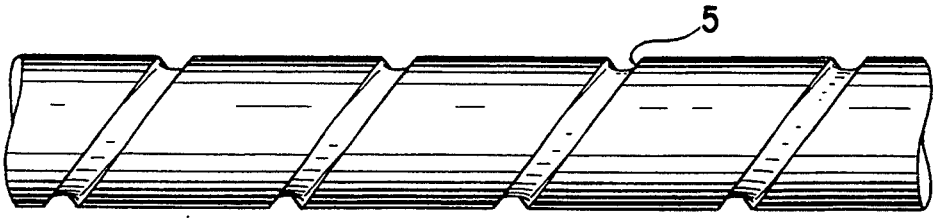
Figure 3C:
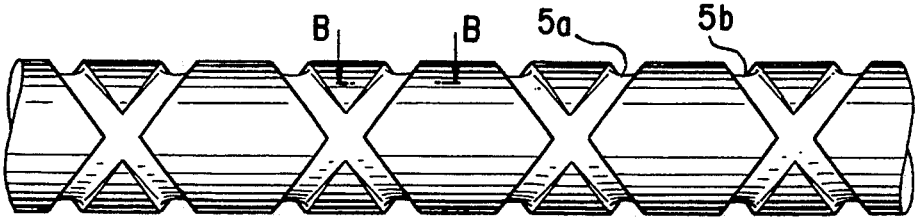
Figure 3D:
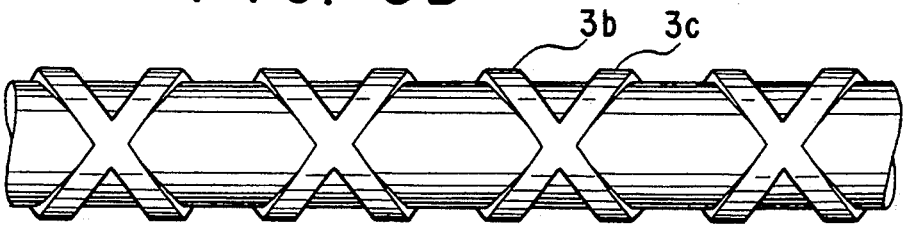
Figure 4:
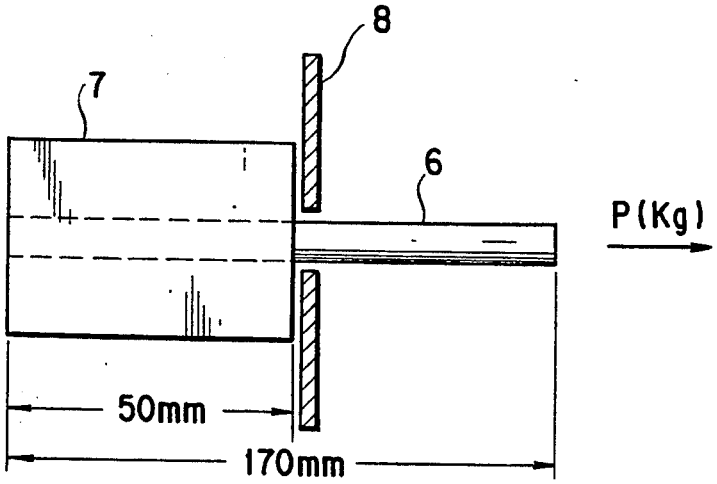
FIG. 4 is an explanatory illustration diagrammatically showing the manner of an adhesion test of a concrete relative to the reinforcement.

The groove 5 as shown in FIG. 3B is a singular groove, and while the grooves **5*a* and 5*b* in FIG. 3C form dual grooves intersecting to each other. In these case, the section of the grooves 5, 5*a* and 5*b* is as illustrated in FIG. 2B. As can be seen from FIG. 2B, even in this case, the reinforcing fiber 4 is maintained in series over the core portion 2 and the grooves 5, 5*a* and 5*b***.

Here, exemplary discussion will be given for the process of fabricating the reinforcement having the intersecting dual grooves **5*a* and 5*b* as illustrated in FIG. 3C**.

Upon forming, a mold of the corresponding configuration of the reinforcement is separated into two segments in an extruding direction. On the inner surface of both segments of the mold, spiral projections in the corresponding configurations to the grooves to be formed are projected. Then, both segments are driven to rotate in mutually opposite rotating directions at an angular velocity corresponding to the spiral pitches to form the reinforcement. In such case, one of the segments is adapted to form the spiral groove **5*a* and the other segment is adapted to form the spiral groove 5*b*. Molten or softened resin matrix with reinforcing fiber is extruded into the rotating segments to path therethrough. The extrusion speed of the molten or softened resin matrix with the reinforcing fiber is adjusted to be synchronous with the rotation of the mold so that the predetermined pitch of the spiral grooves can be impressed on the surface of the material. Therefore, at the end of the mold, the dual grooves having opposite spiral direction can be formed. In this case, since the grooves are formed by impression without employing the cutting process, the reinforcing fiber 4 becomes series over the core portion and the grooves as illustrated in FIG. 2B. Therefore, by curing the reinforcement material on which the dual, intersecting grooves 5*a* and 5*b* are formed, the FRP reinforcement with the dual, intersecting grooves can be formed with series fiber. The alternative process may be applicable for the reinforcement material after molding process, in which the reinforcement material is formed into plain cylindrical rod shaped configuration. In this case, before curing of the formed reinforcement material, a pair of impression strips are wound in mutually opposite winding directions with rotating and feeding the reinforcement material at the desired angular velocity and feeding speed corresponding to the desired pitches of the grooves to be formed on the surface of the reinforcement material. In this case, the groove 5*a* is formed with one impression strip and the groove 5*b*** is formed with the other impression strip.

The later process and the apparatus to be used for implementing the process have been disclosed in the commonly owned International Patent Application No. PCT/JP92/01270, filed on Oct. 1, 1992. The disclosure of the above-identified commonly owned International Patent Application is herein incorporated by reference.

As preferred materials for the reinforcement set forth above, the matrix resin is selected among thermosetting resin, such as epoxy resin, unsaturated polyester, phenol resin or so forth and thermoplastic resin, such as nylon, polyester or so forth. On the other hand, the reinforcing fiber is selected among inorganic fiber, such as carbon fiber, Glass fiber or so forth, organic fiber, such as aramid fiber or so forth. In short, as the material for the matrix and the reinforcing fiber, any suitable materials for forming FRP can be used.

Exemplary, a result of adhesion test with the FRP reinforcement formed employing carbon fiber as the reinforcing fiber and epoxy resin as the matrix resin and applied for the concrete structure as the reinforcement in place of deformed iron reinforcement, is shown in the following table 1.

TABLE 1

| Form | Adhering Force (Kgf/cm) |
|---|---|
| Normal Product | 27 |
| Single Groove | 35 |
| Intersecting Groove | 65 |
| Iron Reinforcement | 68 |

In the foregoing table 1, the normal product represents the FRP reinforcement having plain surface without no uneven profile. The single groove represents the FRP reinforcement with singular groove as illustrated in FIG. 3B. The intersecting groove represents the FRP reinforcement with the dual, intersecting grooves as illustrated in FIG. 3C. The iron reinforcement represents the conventional deformed iron reinforcement.

With the above-mentioned four kinds of reinforcements, test pieces of the illustrated dimension are formed by adhering and curing fast-setting cement 7 at one end of the reinforcement 6. Then, with abutting the fast-setting cement 7 onto an abutting plate 8, a tension is applied to the other end of the reinforcement 6 in the condition of 5 mm/min. Adhering forces up to loosening off of the fast-setting concrete are measured and compared with respect to respective test pieces.

As can be clear from the foregoing table 1, in case that the intersecting grooves are formed as in the shown embodiment, the adhering force comparable with the commonly used deformed iron reinforcement can be achieved.

Figure 5:
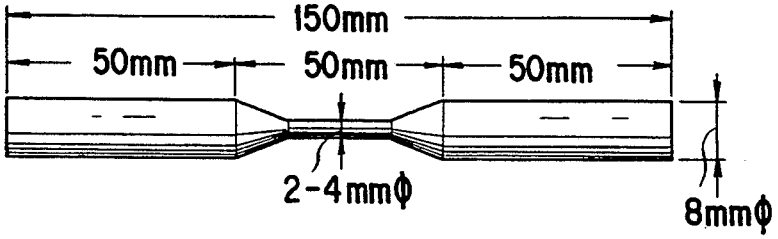
FIG. 5 is an explanatory illustration showing a test piece to be employed in a tensile test of the FRP reinforcement with a spiral groove.

On the other hand, physical properties of the bear FRP reinforcement with the intersecting groove, corresponding to the embodiment of the invention illustrated in FIG. 3C are measured. It should be noted that bending strength and bending modules are measured using test pieces of 8 mm$\phi$ and tensile strength is measured using test pieces having dimensions illustrated in FIG. 5. The results of the tests are shown in the following table 2.

TABLE 2

| | Tensile Strength (Kgf/mm$^2$) | Bending Strength (Kgf/mm$^2$) | Bending Modules (Kgf/mm$^2$) |
|---|---|---|---|
| No. 1 | 196 | 115 | 13000 |
| No. 2 | 194 | 111 | 12700 |
| No. 3 | 185 | 108 | 12300 |
| No. 4 | 208 | 113 | 12400 |

Next, discussion will be given for the result of a four point static load test performed for respective concrete structure, in which the FRP reinforcement with the intersecting grooves corresponding to the embodiment of the invention of FIG. 3C.

The results of the comparative test for the case where the FRP reinforcement illustrated in FIG. 3C is applied to the concrete structure and for the case where the typical deformed iron reinforcement as comparative example, are shown in the following tables 3 and 4. It should be noted that the table 3 shows the physical properties of both test pieces and the table 4 shows the results of loading.

TABLE 3

| Reinforcement | Strength (Kg/cm$^2$) | Sectional Area (cm$^2$) | Elastic Modules (Kg/cm$^2$) |
|---|---|---|---|
| FRP Reinforcement with Spiral Groove (A8) | 18600 | 0.5 | $1.5 \times 10^6$ |
| Iron Reinforcement | 5000 | 1.27 | $2.1 \times 10^6$ |

TABLE 3-continued

| Reinforcement | Strength (Kg/cm$^2$) | Sectional Area (cm$^2$) | Elastic Modules (Kg/cm$^2$) |
|---|---|---|---|
| (A13) | | | |

TABLE 4

| Reinforcement | Cracking Load (ton) | Destructive Test (ton) | Deflection at 1.5 ton Load |
|---|---|---|---|
| FRP Reinforcement with Spiral Groove | 0.5 | 4.5 | 32 |
| Iron Reinforcement | 0.4 | 3.5 | 11 |

Figure 6A:
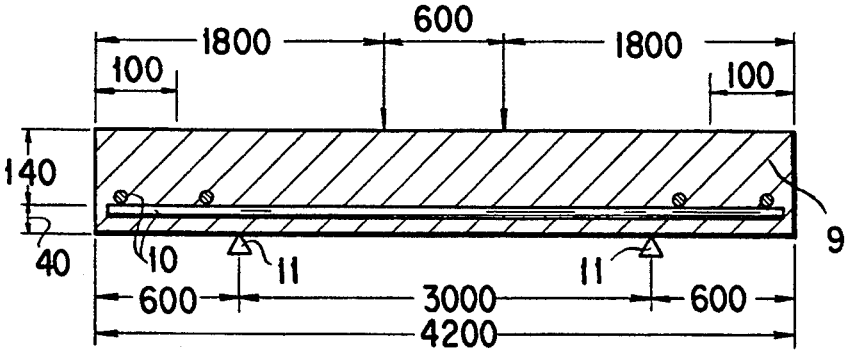
Figure 6B:
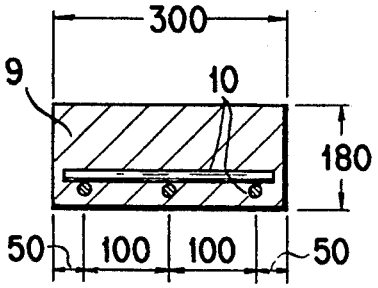
FIG. 6B is a sectional side elevation.

The manner of above-mentioned testing method and loading condition are shown in FIGS. 6A and 6B. In the drawings, the reference numeral 9 represents a concrete structures reinforced by respective reinforcements for comparison, and 11 denotes a fulcrum.

In this case, as can be clear from the table 4, the FRP reinforcement is superior over the iron reinforcement in the cracking load and the destructive load. The resultant cracking load demonstrates comparable or superior adhering performance to or over the iron reinforcement. Also, the resultant destructive load demonstrates sufficient reinforcement effect as RC structure.

Next, the results of comparative tests for the case where the FRP reinforcement with the intersecting grooves of FIG. 3C is used as a tension member for the pre-stressed concrete structure and for the case where a carbon fiber strand which is conventionally known to have a comparable adhering performance to PC steel wire, is used as the tension member for the pre-stressed concrete structure, are shown in the following tables 5 and 6. It should be noted that the physical properties of both test pieces are shown in the table 5 and the loading results are shown in the table 6.

TABLE 5

| Tension member | Cable Construction | Sectional Area (cm$^2$) | Destructive Load (Kg) | Elastic Modules (Kg/cm$^2$) |
|---|---|---|---|---|
| FRP Reinforcement With Spiral Groove | Multi-7-$\phi$8 | 3.43 | 53900 | $1.5 \times 10^6$ |
| Carbon Fiber Strand | Multi-3 $\phi$12.5 | 2.28 | 43500 | $1.4 \times 10^6$ |

TABLE 6

| Tension Member | Destructive Load (ton) | Deflection at 1.5 ton Load |
|---|---|---|
| FRP Reinforcement with Spiral Groove | 6.4 | 4.2 |
| Carbon Fiber Strand | 5.2 | 4.5 |

Figure 7A:
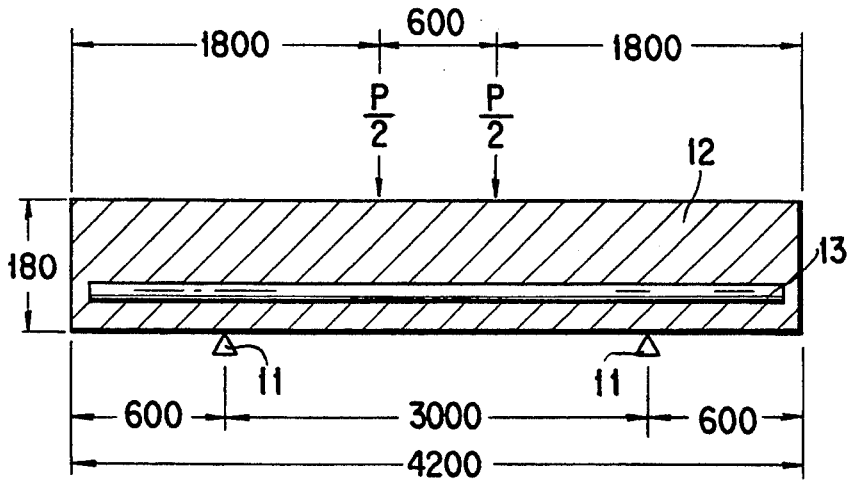
Figure 7B:
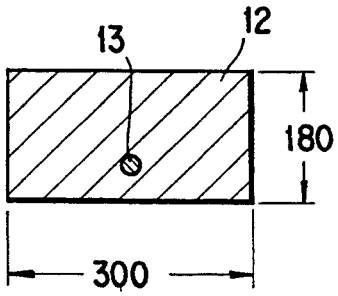

The manner and loading conditions are illustrated in FIGS. 7A and 78. In the drawings, the reference numeral 12 denotes the concrete structure for which the tension member is applied.

In this case, as can be clear from the table 6, when the FRP reinforcement is employed, comparable destructive load and the deflection to that of the carbon fiber strand can be obtained. Therefore, it can be appreciated that the FRP reinforcement employed as the tension member for the pre-stressed concrete, it exhibits equivalent adhering property to the PC steel strand. This confirms that the FRP reinforcement according to the present invention is suitable as the tension member for the pre-stressed concrete.

It should be noted, in the foregoing respective embodiments, it is preferred to have the small height of the projected portions or the small depth of the grooves so as not to degrade the tensile strength. For instance, the preferred range of the height of the projected portion and/or the depth of the groove is 1/1000 to 1/10 of the diameter of the reinforcement.

Also, the wider width of the groove or interval of the projected portions is preferred in the light of the shearing strength since greater amount of concrete can be received therein. The preferred range of the width is 1/3 to 1/1 of the diameter of the reinforcement. Furthermore, the smaller pitch of the grooves is preferred for greater number of grooves can be provided for higher concrete adhering strength. The preferred pitch is in a range of 1 to 6 times of the diameter of the reinforcement.

Therefore, the embodiment of the FRP reinforcement having the dual, intersecting grooves can provide high concrete adhering strength with small depth of the grooves which contributes for increasing of the tensile strength.

As set forth above, according to the present invention, since the reinforcing fiber can be maintained in series despite of the uneven profile on the surface and extend over the uneven portion and the core portion, the FRP reinforcement can exhibit remarkably high shearing strength. Furthermore, in case of the FRP reinforcement having the projected portions, the series reinforcing fiber may provide sufficient strength for withstanding to stress concentrated to the raising edge of the projected portion.

Figure 8A:
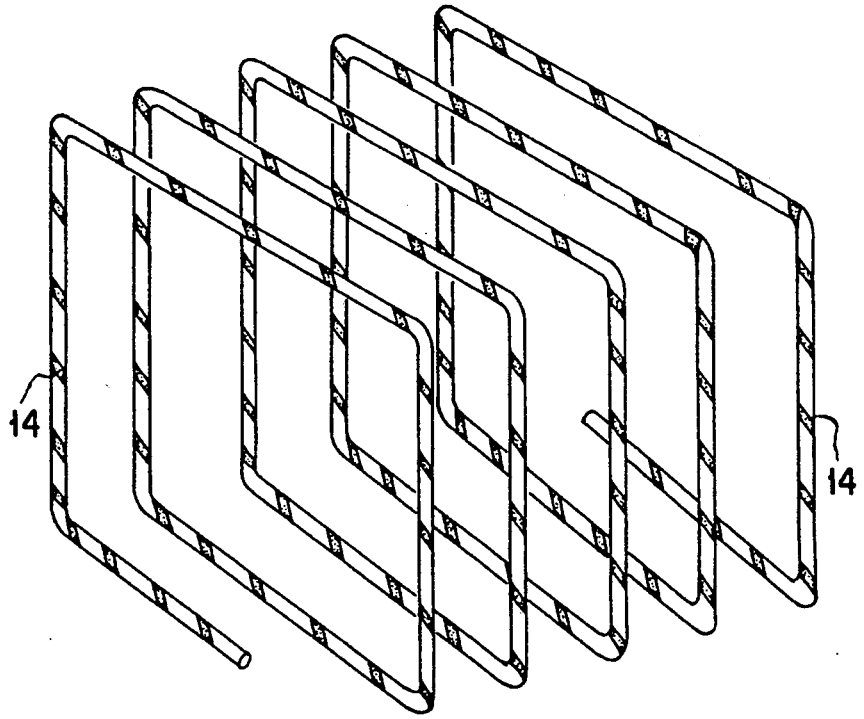
Figure 8B:
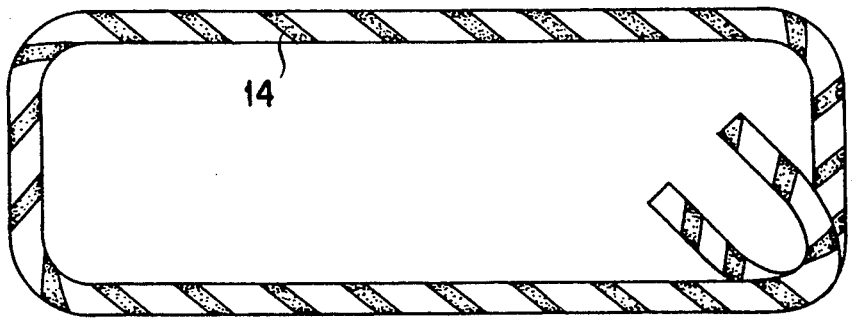
Figure 9:
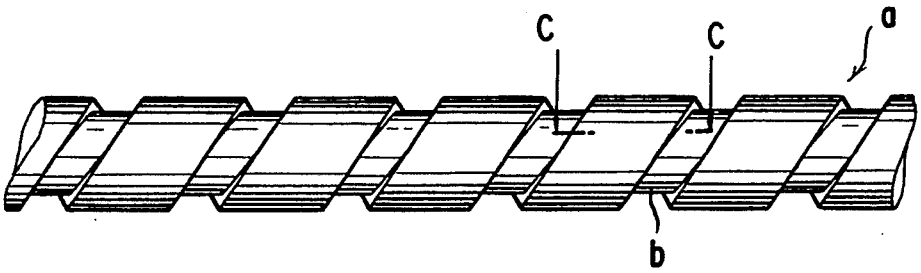
FIG. 9 is a front elevation of the prior art.
Figure 10:
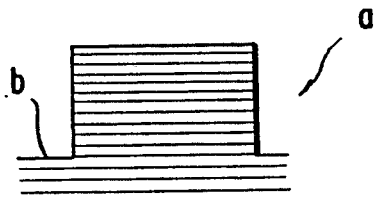
FIG. 10 is an enlarged section taken along line C—C of FIG. 9.
Figure 11:
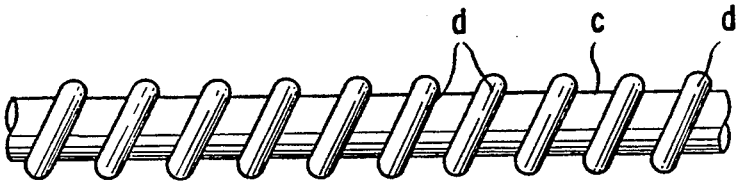
FIG. 11 is a front elevation of another prior art.

When the FRP reinforcement according to the present invention is applied as the reinforcement for the concrete, it can exhibit excellent axial shearing strength to provide sufficient resistance against high load exerted on the concrete structure. These effects can also be attained when the FRP reinforcement according to the present invention is applied for stirrup reinforcement or hoop reinforcement as illustrated in FIGS. 8A and 8B. It should be noted that in these figures, the reference numeral 14 denotes the groove.

On the other hand, when the reinforcement according to the present invention is employed as the reinforcement for the precasted concrete, even if the tension is applied to the reinforcement in advance of curing of the concrete, the series fiber extending over the core and the uneven portions will exhibit the effects set forth above so that it may successfully withstand to a tension force after releasing of the tension to provide sufficient strength as the tension member of the pre-stressed concrete.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A fiber reinforced plastic reinforcement, for a concrete structure comprising:

a core made of a fiber reinforced plastic material composed of a matrix resin and reinforcing fiber;

an uneven profile portion integrally formed on a peripheral surface portion of said core so as to provide alternately arranged first higher portions and second lower portions, wherein said reinforcing fiber extends in series across said core and said uneven profile portion and wherein said first higher portions are positioned radially outside beyond said second lower portions in a distance range of 1/1000 to 1/10 times a diameter of said reinforcement.

2. A fiber reinforced plastic reinforcement for a concrete structure, comprising:

a core made of a fiber reinforced plastic material composed of a matrix resin and reinforcing fiber;

an uneven profile portion integrally formed on a peripheral surface portion of said core so as to provide alternately arranged first higher portions and second lower portions, wherein said reinforcing fiber extends in series across said core and said uneven profile portion, wherein the width of said second lower portion is in a range of 1/3 to 1/1 times the diameter of said reinforcement.

3. A fiber reinforced plastic reinforcement for a concrete structure, comprising:

a core made of a fiber reinforced plastic material composed of a matrix resin and reinforcing fiber;

uneven profile portion integrally formed on a peripheral surface..portion of said core so as to provide alternately arranged first higher portions and second lower portions, wherein said reinforcing fiber extends in series across said core and said uneven profile portion, wherein a pitch of said second lower portions is in a range of 1 to 6 times the diameter of said reinforcement.

4. A fiber reinforced plastic reinforcement for a concrete structure, comprising:

a core made of a fiber reinforced plastic material composed of a matrix resin and reinforcing fiber;

an uneven profile portion integrally formed on a peripheral surface portion of said core so as to provide alternately arranged first higher portions and second lower portions, wherein said reinforcing fiber extends in series across said core and said uneven profile portion, and said second lower portions are formed by grooves formed integrally with said core, through which grooves and said core, said reinforcing fiber extends in series.

5. A fiber reinforced plastic reinforcement as set forth in claim 4, wherein said first higher portions are formed by projections formed integrally with said core, through which projections and said core, said reinforcing fiber extends in series.

6. A fiber reinforced plastic reinforcement as set forth in claim 5, wherein said first higher portions are formed with a sequence of projections extending around the peripheral portion of said core in a spiral fashion.

7. A fiber reinforcement plastic reinforcement as set forth in claim 5, wherein said first higher portions are formed with two elongated projections extending around the peripheral portion of said core in a mutually intersecting fashion.

8. A fiber reinforced plastic reinforcement as set forth in claim 4, wherein said second lower portions are formed with a sequence of grooves extending around the peripheral portion of said core in a spiral fashion.

9. A fiber reinforcement plastic reinforcement as set forth in claim 4, wherein said second lower portions are formed with two elongated grooves extending around the peripheral portion of said core in a mutually intersecting fashion.

10. A fiber reinforced plastic reinforcement as set forth in claim 9, wherein said two grooves are formed on the peripheral portion of said core in a spiral fashion with mutually opposite spiral directions.

11. A fiber reinforced plastic reinforcement as set forth in claim 4, wherein said groove is formed by an impression in a fabrication process before completely curing said matrix resin.

12. A fiber reinforced plastic reinforcement as set forth in claim 4, wherein said first higher portions are positioned radially outside beyond said second lower portions in a distance range of 1/1000 to 1/10 times a diameter of said reinforcement.

13. A fiber reinforced plastic reinforcement as set forth in claim 4, wherein the width of said second lower portion is in a range of 1/3 to 1/1 times the diameter of said reinforcement.

14. A fiber reinforced plastic reinforcement as set forth in claim 4, wherein a pitch of said second lower portions is in a range of 1 to 6 times the diameter of said reinforcement.

* * * * *